US009355624B2

(12) United States Patent
Lee

(10) Patent No.: US 9,355,624 B2
(45) Date of Patent: May 31, 2016

(54) DRUM PEDAL WITH DYNAMIC TENSION

(71) Applicant: Mark Quinten Lee, East Aurora, NY (US)

(72) Inventor: Mark Quinten Lee, East Aurora, NY (US)

( * ) Notice: Subject to any disclaimer, the term of this patent is extended or adjusted under 35 U.S.C. 154(b) by 4 days.

(21) Appl. No.: 14/507,150

(22) Filed: Oct. 6, 2014

(65) Prior Publication Data

US 2015/0096429 A1 Apr. 9, 2015

Related U.S. Application Data

(60) Provisional application No. 61/886,766, filed on Oct. 4, 2013.

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
CPC ..... G10D 13/006
USPC ..... 84/422.1
See application file for complete search history.

(56) References Cited

U.S. PATENT DOCUMENTS 4,048,896 A * 9/1977 Calato ..... G10D 13/006 84/422.1

* cited by examiner

*Primary Examiner* — Jianchun Qin

(57) ABSTRACT

An improved drum pedal utilizes an advanced dampening system in combination with a base, pedal, beater assembly, and support structure. The pedal is mounted to the base while the support structure forms a first pillar and second pillar that allow rotation of an axle positioned between them. A cam on the axle is connected to the pedal by a first chain, allowing the beater assembly to be actuated by the pedal. The dampening system provides an opposed first dampening mechanism and second dampening mechanism, which are tethered to each other by a second chain. The second chain is engaged with a sprocket that is connected to the axle, such that rotation of the axle results in corresponding movement of the dampening mechanisms. Compression springs, combined with cylinders and flanges, respond to movement of the axle with dynamic tension. This is an improvement over the spring implementation of current drum pedals.

8 Claims, 8 Drawing Sheets

DRUM PEDAL WITH DYNAMIC TENSION

The current application claims a priority to the U.S. Provisional Patent application Ser. No. 61/886,766 filed on Oct. 4, 2013.

FIELD OF THE INVENTION

The present invention relates generally to a drum pedal system that provides dynamic tension in order to achieve smoother, faster, and more predictable beater action.

BACKGROUND OF THE INVENTION

In the modern day society, there are many forms of entertainment. One could watch TV, go to a sports game, go for a hike, or even listen to music to name a few. Music plays a huge part in American culture. From the radio, to concerts, to mp3 players, music is an everyday part of life. In music, all songs begin with an instrument. There are instruments to play the lead, the chorus, and the rhythm. But every song must have one essential piece, the beat. That basic and important part of song all starts with the drum. The drum dates back to the beginning of mankind. Tribes used drums for spiritual rituals and entertainment. The drum has evolved and become an essential instrument in the world today.

In the music industry many bands require the use of a drum set. The drums provide the beat that is essential for the rhythm of the song. More specifically, every drum set has a bass drum. The bass drum is the largest drum in the set and stands vertically on the ground. The bass drum produces notes that are very low in pitch.

To beat the drum, the drummer will push on a traditional pedal system causing a beater to hit the drum. The traditional pedal usually has one spring in tension to move the beater. The further the beater is pressed, the stronger the resistive force is. This can be a problem because at the lowest spring point there is less control. This can make the length of time it takes for the beater to go from the striking position to the resting position unpredictable. The position of the system is also not very predictable. This can lead to inaccurate beats played by the musician. The single spring in tension system also gives the pedal a resistant feel instead of a smooth response. This traditional pedal system may be fine for beginning drummers, but advanced musicians may want a system that delivers more control and better response of the beater.

The present invention accomplishes this task through a specifically designed spring dynamic tension system. Instead of the single tension spring system, the present invention encompasses the use of two compressive springs in opposition.

Heavier spring gauges can be used because one spring will not be carrying all the tension, as it is in the single spring in tension design. Instead, the two springs will be acting in compression and will provide a constant resistance throughout the strike cycle. The constant resistance in the cycle is obtained from the force in one spring increasing as the force on the other decreases. The pedal will also have a longer life span. Instead of relying on only one spring, two springs will be used. This results in less mechanical wear on each individual spring.

This present invention will give the user the ability to use heavier spring gauges, give the pedal a longer life, and create a less resistant feel.

DETAIL DESCRIPTIONS OF THE INVENTION

Figure 1:
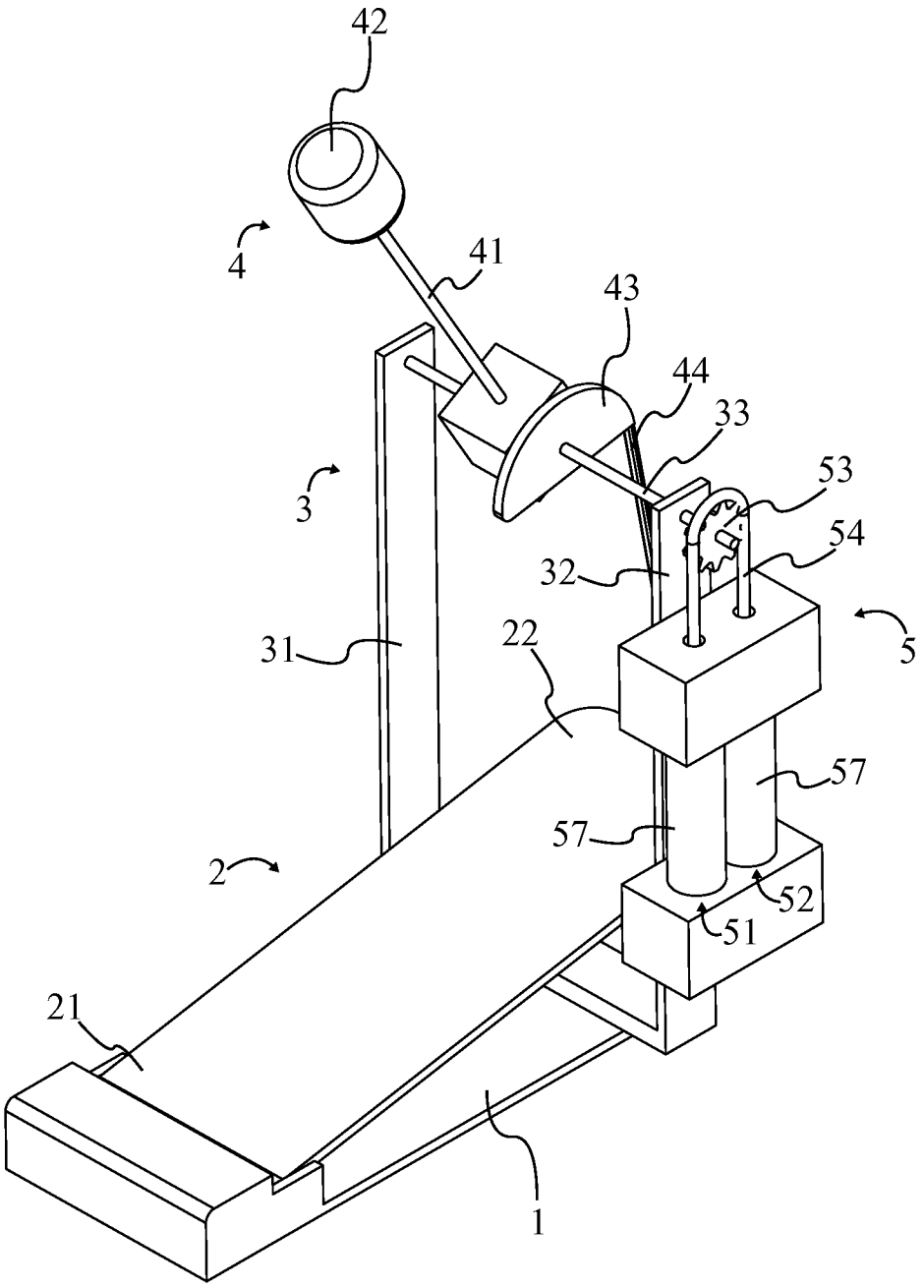
FIG. 1 is a perspective view of the present invention.
Figure 2:
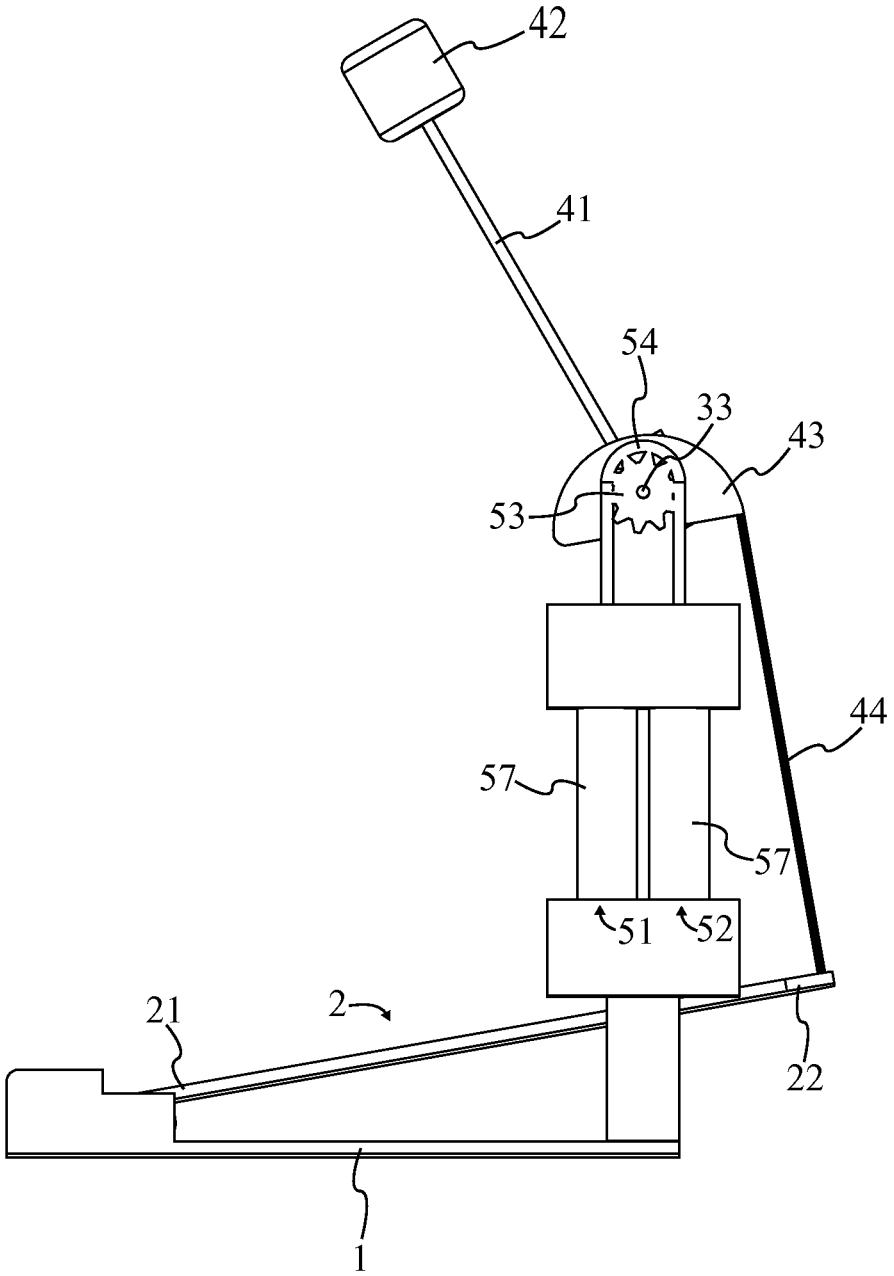
FIG. 2 is a right side view thereof.
Figure 3:
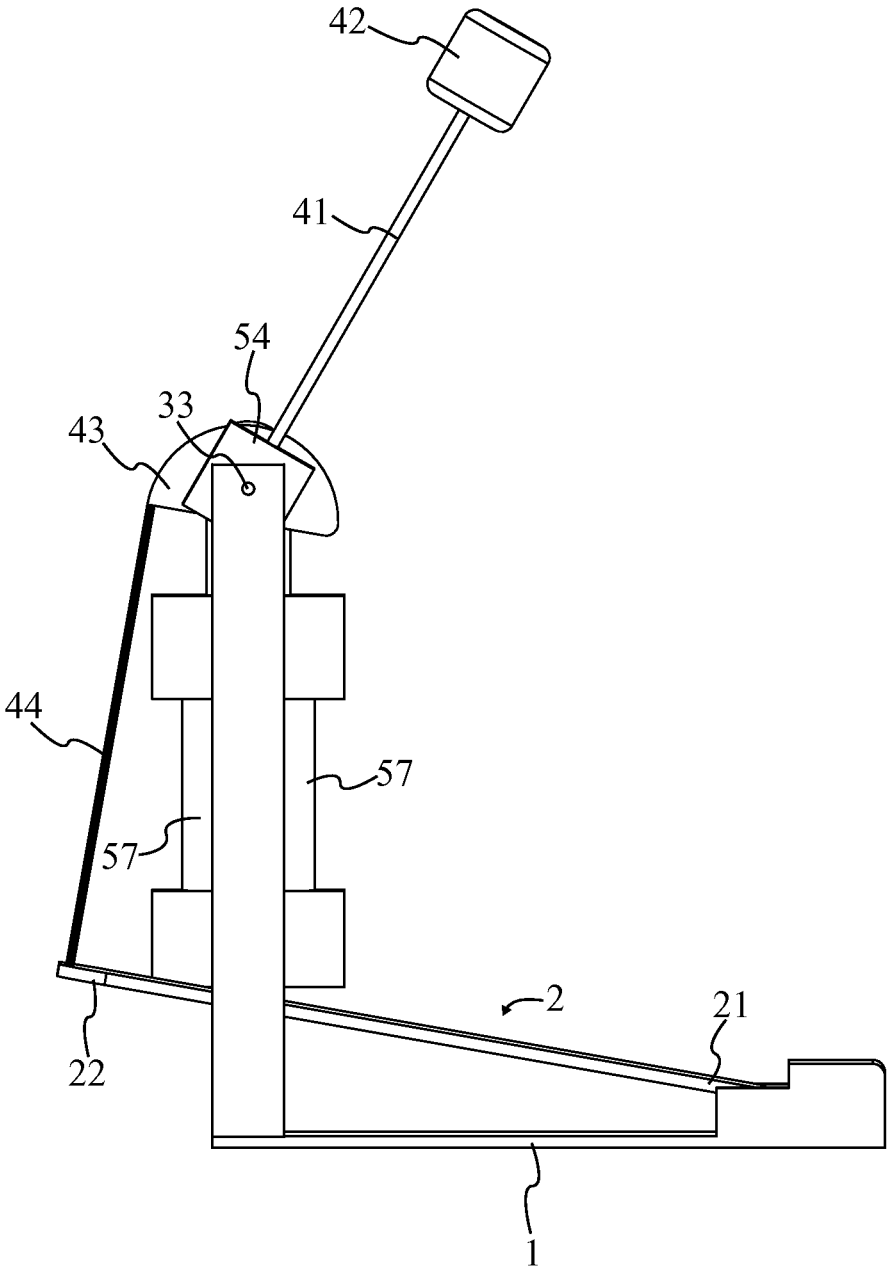
FIG. 3 is a left side view thereof.
Figure 4:
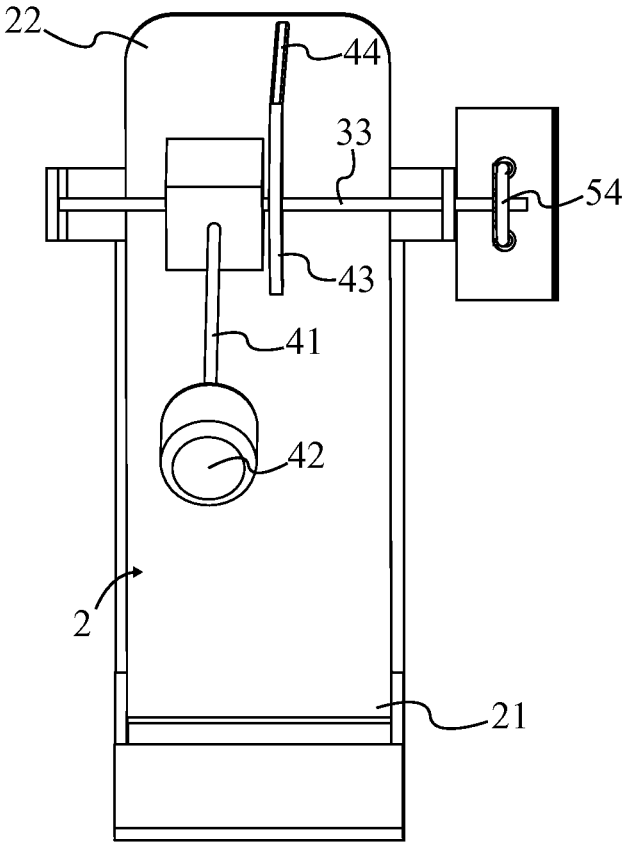
FIG. 4 is a top view thereof.
Figure 5:
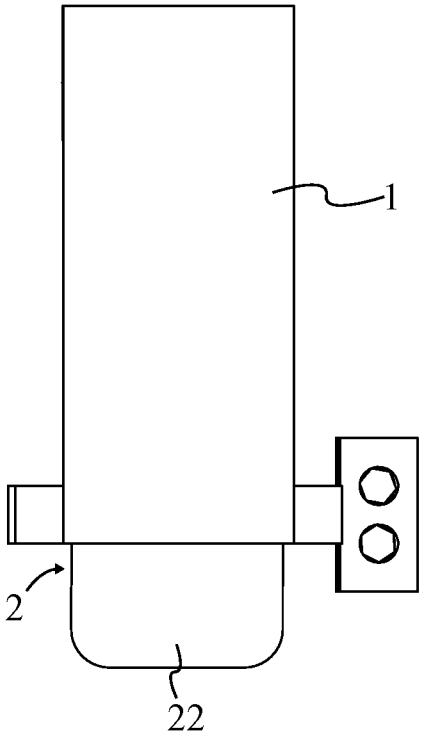
FIG. 5 is a bottom view thereof.
Figure 6:
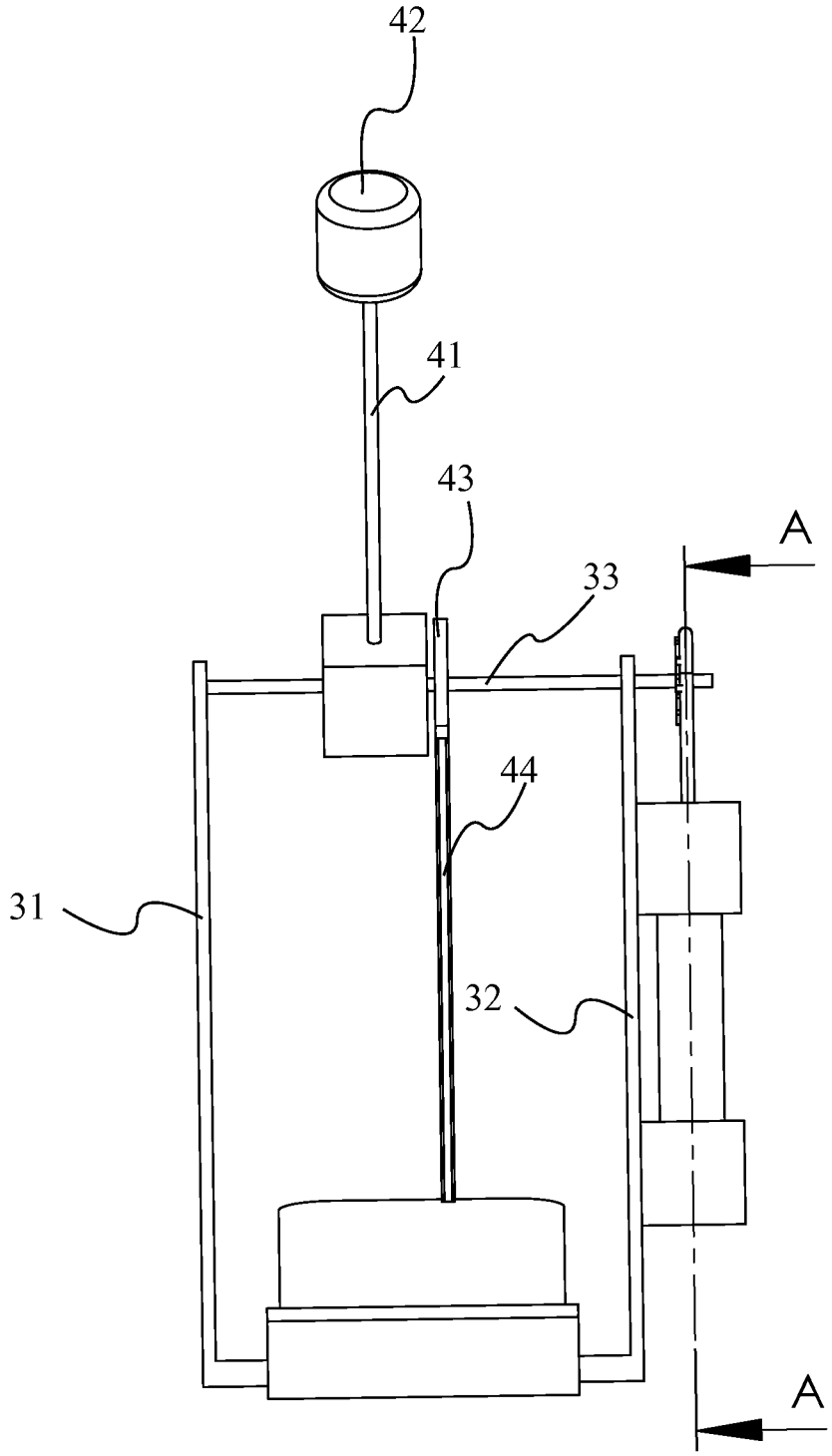
FIG. 6 is a front view thereof, showing the plane upon which a cross-sectional view is taken and shown in FIG. 7.

All illustrations of the drawings are for the purpose of describing selected versions of the present invention and are not intended to limit the scope of the present invention.

The present invention is a drum pedal system that provides constant resistance to a user during the strike cycle. The present invention comprises a base 1, a pedal 2, a support structure 3, a beater assembly 4, and a dampening system 5. The base 1 receives the pedal 2 and the support structure 3, while the beater assembly 4 and dampening system 5 are mounted to the support structure 3. The pedal 2 allows the user to actuate the beater assembly 4 and thus strike a drum. The dampening system 5 serves to provide an improved user experience in terms of control and feel with respect to operating the pedal 2. The present invention is illustrated via FIG. 1-FIG. 8.

As the support structure 3 is designed to allow operation of the beater assembly 4 and associated dampening mechanism, said support structure 3 comprises a first pillar 31, a second pillar 32, and an axle 33. The axle 33 is installed between the first pillar 31 and the second pillar 32, which elevate the axle 33 as well as allow for its rotation. Effectively, the axle 33 is rotatably connected between the first pillar 31 and the second pillar 32. The beater assembly 4 is mounted to the axle 33, such that rotation of the axle 33 induces corresponding rotation of the beater assembly 4; this is what allows the present invention to strike the drum. The beater assembly 4 comprises an arm 41, a head 42, a cam 43, and a first chain 44. The arm 41 is adjacently connected to the axle 33, in a perpendicular orientation. The cam 43 is installed directly on the axle 33; this axial connection allows the cam 43 to convert linear motion (i.e. of the first chain 44) into rotational motion (i.e. of the axle 33). Joining the pedal 2 to the cam 43 is the first chain 44, which is connected to the pedal 2 at one end and perimetrically engaged with the cam 43 at an opposite end. This configuration results in tethering of the cam 43 to the pedal 2 by the first chain 44, such that when a user depresses the pedal 2 the chain pulls on the cam 43 and causes the axle 33 and connected arm 41 to rotate. The core setup at thusfar described allows for basic operation of the present invention as a drum pedal. The improved dampening system 5 implemented by the present invention is subsequently described.

The dampening system 5 comprises a first dampening mechanism 51, a second dampening mechanism 52, a sprocket 53, and a second chain 54. These dampening mechanisms are configured to oppose each other, with the first dampening mechanism 51 and the second dampening mechanism 52 being tethered to each other by the second chain 54. The second chain 54 itself is coupled to the sprocket 53, the latter of which is axially connected to the axle 33. The sprocket 53 and second chain 54 serve to engage the beater assembly 4 with the dampening system 5, allowing the dampening system 5 to smooth action of the beater assembly 4 and improve user experience. To complete this coupling, the second chain 54 is perimetrically engaged about the sprocket 53. As a result, rotation of the axle 33 and connected sprocket 53 causes the chain to pull on one of the dampening mechanisms and press against the opposing dampening mechanism. The configuration heretofore described for the dampening system 5 is best illustrated in FIG. 1-FIG. 3, and FIG. 6-FIG. 8.

The first dampening mechanism 51 and second dampening mechanism 52 are integral components of the present invention. Assisting with their operation, they each comprise a cylinder 55, a flange 56, a tubular body 57, and a compression spring 58. Each cylinder 55 is housed within its corresponding tubular body 57. The cylinder 55 moves within the tubular body 57 as it is pushed and pulled by the coupled second chain 54. When a user uses the pedal 2 to actuate the beater mechanism, the axle 33 rotates and energy is transferred into the compression spring 58. The compression spring 58 and flange 56 then provide an opposing force that works to return the cylinder 55 to its equilibrium position. The dampening mechanisms affect rotation of the axle 33 due to the connecting first chain 44 and sprocket 53. Because there are two dampening mechanisms working in opposition to each other, dynamic tension improves the user experience and control with respect to the pedal 2. These basic concepts are implemented to provide an improved drum pedal mechanism by means of the dampening system 5.

Elaborating upon the components and configuration of the dampening system 5, each cylinder 55 is enveloped by the associated compression spring 58. That is, the compression spring 58 of the first dampening system 5 is helically positioned around the cylinder 55 of the first dampening mechanism 51. The second dampening mechanism 52 mirrors this, with its compression spring 58 being helically positioned around its cylinder 55. The tubular body 57, which houses the cylinder 55, compression spring 58, and flange 56, comprises a narrow segment 571 and an enlarged segment 572. The narrow segment 571 opens up into the enlarged segment 572, forming a single and continuous volume. The narrow segment 571 is sized to allow travel of the cylinder 55, such that the cylinder 55 is slidably engaged with the narrow segment 571. The narrow segment 571 also provides a passage that allows the second chain 54 to be connected to the cylinder 55. In an equilibrium position the cylinder 55 is positioned within the enlarged segment 572, along with the compression spring 58 and the flange 56, and traverses into the narrow segment 571. The flange 56, meanwhile, is adjacently connected to the end of the cylinder 55, opposite the change. The flange 56 serves as a connection point for the compression spring 58, which is affixed to the flange 56, as well as a guiding mechanism. The flange 56 functions as a guide by being slidably engaged with the enlarged segment 572, ensuring the cylinder 55 only moves linearly. The details of the dampening system 5 are more clearly illustrated in FIG. 7 and FIG. 8.

Figure 7:
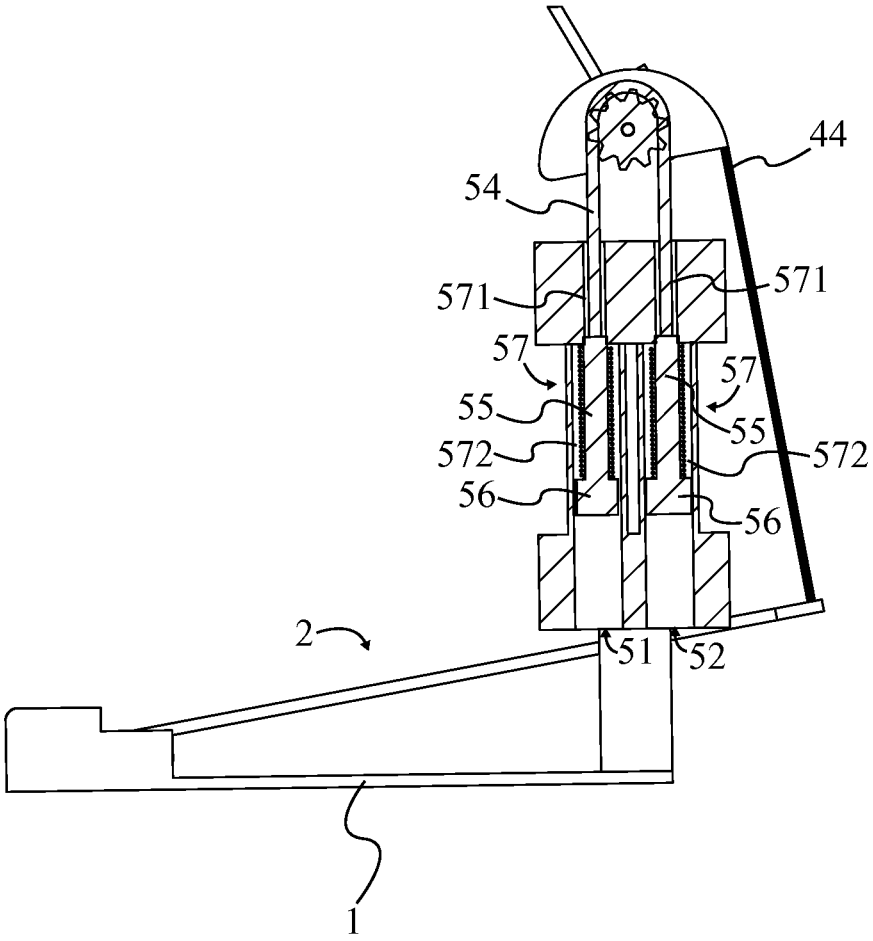
FIG. 7 is a right side view thereof, taken along line A-A of FIG. 6.
Figure 8:
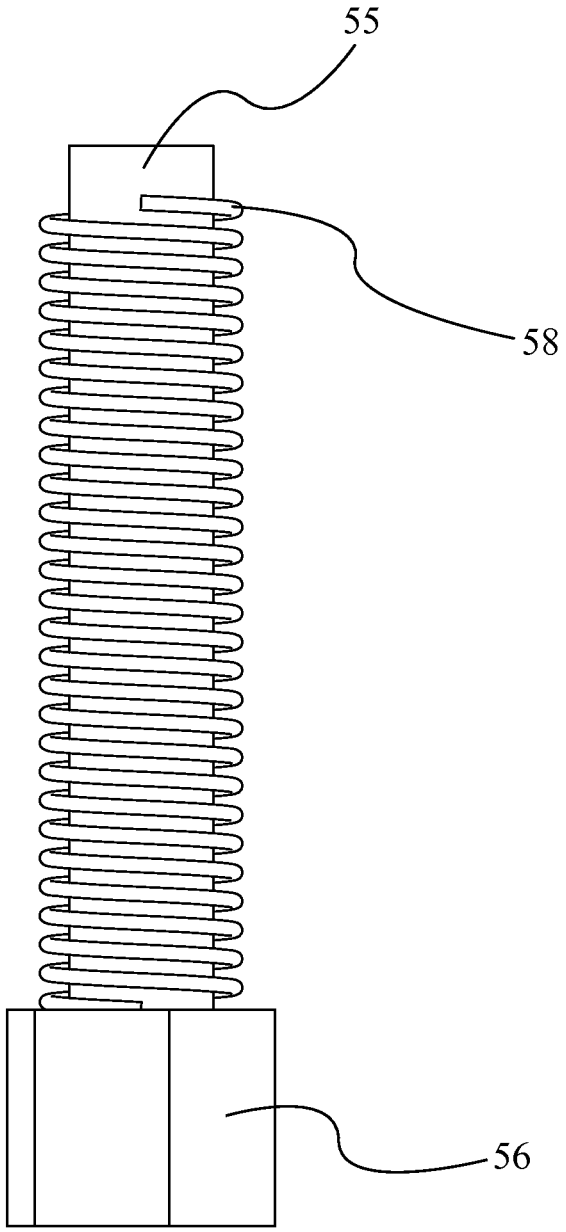
FIG. 8 is a front view of part of the dampening mechanism.

The flange 56 is designed to be congruent with the enlarged segment 572; in other words, the profile of the flange 56 matches the profile of the enlarged segment 572 and is larger than the profile of the narrow segment 571. This design allows the flange 56 to be translated within the enlarged segment 572 while preventing the flange 56 from entering the narrow segment 571. Similarly, the compression spring 58 fits within the enlarged segment 572 but is larger than the narrow segment 571 and thus is prevented from traversing into said narrow segment 571. Thus, when the cylinder 55 is pulled by the second chain 54, the cylinder 55 traverses into the narrow segment 571 while the flange 56 is translated towards the narrow segment 571. As the flange 56 approaches the narrow segment 571, the compression spring 58 is blocked by the rim of the narrow segment 571 and compresses. The compressing of the compression spring 58 results in part of the dynamic tension produced by the present invention. These relations are best shown in FIG. 7.

Since the present invention utilizes a twin dampening mechanism configuration, when one compression spring 58 is compressed the compression spring 58 of the opposing dampening mechanism does not experience compression. The compression spring 58 of the first momentum reacts to being compressed by extending back to its equilibrium position, pushing the correspondingly cylinder 55 up, rotating the axle 33 by means of the sprocket 53, and ultimately transferring energy to the opposing compression spring 58. The dampening system 5 effectively uses oscillation between the compression springs 58 to provide the dynamic tension inherent to the present invention. The specific orientation of the dampening mechanisms can be varied as long as they are configured to oppose each other. For illustrative purposes the dampening mechanisms are shown adjacent to each other, with the tubular body 57 of the first dampening mechanism 51 being parallel with the tubular body 57 of the second dampening mechanism 52. Similarly, while the specific placement of the dampening mechanisms is flexible, they are illustrated showing the tubular bodies 57 being adjacently connected to the second pillar 32, though the tubular bodies 57 could instead be connected to the base 1. Ultimately, while alternative embodiments may adjust positioning and orientation of the dampening mechanisms, said dampening mechanisms will always be coupled with the axle 33 by means of the sprocket 53 and second chain 54.

Supporting the novel elements of the dampening system 5, the pedal 2 serves as an interface that allows a user to actuate the beater assembly 4 and strike the drum. Describing the pedal 2 in more detail, it comprises a mounting end 21 and a free end 22. The mounting end 21 is where the pedal 2 is secured to the base 1, while the free end 22 is allowed to rotate. Since the pedal 2 is designed to utilize lever action, the mounting end 21 is hingedly connected to the base 1. The free end 22 is slightly elevated above the base 1, providing sufficient room for a user to depress the pedal 2. If the free end 22 was instead touching the base 1 in a default position, the base 1 would prevent movement of the pedal 2 and render the pedal 2 inoperative. Since the mounting end 21 is essentially fixed while the free end 22 is capable of moving, the first chain 44 is coupled to the free end 22. This allows the free end 22 to pull down on the first chain 44 when the pedal 2 is depressed, resulting in rotation of the axle 33 via the first chain 44 and cam 43.

The head 42 of the drum is provided as a contact point between the beater assembly 4 and a drum, and is thus connected to the arm 41 opposite the axle 33. Thus the head 42 follows an elliptical path as the pedal 2 is depressed and the motion is transmitted to the arm 41 through the first chain 44, cam 43, and axle 33. Once pressure is removed from the pedal 2 (i.e. a user lifts their foot partly or completely) the arm 41 is free to return to a neutral position, with the dampening system 5 moderating the return by means of the compression springs 58.

To increase leverage of the pedal 2, the support structure 3 is positioned opposite the mounting end 21 of the pedal 2, reducing the amount of force needed for a user to depress the pedal 2. The first pillar 31 and second pillar 32 are positioned at opposite sides of the base 1, providing room for the axle 33 to be placed between them. The first pillar 31 and second pillar 32 are illustrated in an orientation that is perpendicular to the base 1, but different embodiments may alter the orientation without impacting the function of the present invention.

While the present invention has been described regarding one potential embodiment, it is understood that modifications and alterations are possible while remaining under the scope of the preset invention. For example, the chains could be replaced by belts, as seen with some existing drum pedals. Dual pedal setups could potentially be implemented. The dampening mechanism could be completely enclosed rather than being partially exposed as seen in the accompanying illustrations. These are just a few non-limiting examples of potential variant embodiments. A number of embodiments are possible as long as they adhere to the core concept of opposing compression springs 58 that act to dampen the beater assembly 4 and provide dynamic tension.

Although the invention has been explained in relation to its preferred embodiment, it is to be understood that many other possible modifications and variations can be made without departing from the spirit and scope of the invention as hereinafter claimed.

What is claimed is:

1. A drum pedal with dynamic tension comprises:

a base;

a pedal;

a support structure;

a beater assembly;

a dampening system;

the support structure comprises a first pillar, a second pillar, and an axle;

the axle being rotatably connected between the first pillar and the second pillar;

the beater assembly comprises an arm, a head, a cam, and a first chain;

the arm being adjacently and perpendicularly connected to the axle;

the cam being axially connected to the axle;

the cam being tethered to the pedal by the first chain;

the first chain being perimetrically engaged with the cam;

the dampening system comprises a first dampening mechanism, a second dampening mechanism, a sprocket, and a second chain;

the first dampening mechanism and the second dampening mechanism being tethered to each other by the second chain;

the sprocket being axially connected to the axle;

the second chain being perimetrically engaged about the sprocket;

the first dampening mechanism and the second dampening mechanism each comprise a cylinder, a flange, a tubular body, and a compression spring;

the compression spring being helically positioned around the cylinder;

the cylinder of the first dampening mechanism being tethered to the cylinder of the second dampening mechanism by the second chain;

the tubular body of the first dampening mechanism being positioned adjacent to the tubular body of the second dampening mechanism;

the tubular body comprises a narrow segment and an enlarged segment;

the cylinder being slidably engaged with the narrow segment;

the flange being slidably engaged with the enlarged segment; and the compression spring being adjacently connected to the flange.

2. The drum pedal with dynamic tension as claimed in claim 1 comprises:

the flange being congruent with the enlarged segment, wherein the flange is prevented from traversing into the narrow segment.

3. The drum pedal with dynamic tension as claimed in claim 1 comprises:

the tubular body of the first dampening mechanism being parallel with the tubular body of the second dampening mechanism.

4. The drum pedal with dynamic tension as claimed in claim 1 comprises:

the tubular body being adjacently connected to the second pillar.

5. The drum pedal with dynamic tension as claimed in claim 1 comprises:

the pedal comprises a mounting end and a free end;

the mounting end being hingedly connected to the base; and the cam being operatively coupled to the free end by the first chain.

6. The drum pedal with dynamic tension as claimed in claim 1 comprises:

the support structure being positioned opposite the mounting end along the base.

7. The drum pedal with dynamic tension as claimed in claim 1 comprises:

the first pillar being adjacently and perpendicularly connected to the base;

the second pillar being adjacently and perpendicularly connected to the base; and the first pillar and the second pillar being positioned opposite each other across the base.

8. The drum pedal with dynamic tension as claimed in claim 1 comprises:

the head being adjacently connected to the arm; and the head being positioned opposite the axle along the arm.

* * * * *